United States Patent [19]

Drew

[11] Patent Number: 4,532,849

[45] Date of Patent: Aug. 6, 1985

[54] SIGNAL SHAPE CONTROLLER

[76] Inventor: Dennis M. Drew, 35 Indiana St., Rochester, N.Y. 14609

[21] Appl. No.: 561,686

[22] Filed: Dec. 15, 1983

[51] Int. Cl.[3] ..... G10H 1/057

[52] U.S. Cl. ..... 84/1.22; 84/1.24; 84/1.26; 381/51

[58] Field of Search ..... 84/1.01, 1.03, 1.11–1.13, 84/1.19–1.24, 1.26; 381/41, 51–53, 61, 118; 364/419, 718, 733, 754

[56] References Cited

U.S. PATENT DOCUMENTS

| | | | |
|---|---|---|---|
| 3,250,843 | 5/1966 | Jenny . | |
| 3,539,701 | 11/1970 | Milde . | |
| 3,755,626 | 8/1973 | Lace . | |
| 3,875,537 | 4/1975 | Dolby . | |
| 3,934,084 | 1/1976 | Munson et al. . | |
| 3,934,190 | 1/1976 | Dolby . | |
| 4,036,096 | 7/1977 | Tomisawa | 84/1.01 |
| 4,050,343 | 9/1977 | Moog . | |
| 4,068,092 | 1/1978 | Ikoma et al. . | |
| 4,079,650 | 3/1978 | Deutsch et al. | 84/1.26 |
| 4,101,849 | 7/1978 | Blackmer et al. . | |
| 4,112,254 | 9/1978 | Blackner . | |
| 4,130,043 | 12/1978 | Niimi | 84/1.26 X |
| 4,135,422 | 1/1979 | Chibana | 84/1.01 |
| 4,138,915 | 2/1979 | Nagai et al. | 84/1.22 |
| 4,142,432 | 3/1979 | Kameyama et al. | 84/1.01 |
| 4,145,664 | 3/1979 | Takaoka et al. . | |
| 4,151,368 | 4/1979 | Fricke et al. . | |
| 4,180,707 | 12/1979 | Moog . | |
| 4,185,532 | 1/1980 | Hiyoshi et al. . | |
| 4,189,973 | 2/1980 | Doane . | |
| 4,195,544 | 4/1980 | Koike . | |
| 4,201,105 | 5/1980 | Alles . | |
| 4,202,238 | 5/1980 | Moog . | |
| 4,203,338 | 5/1980 | Vidas . | |
| 4,213,367 | 7/1980 | Moog . | |
| 4,250,789 | 2/1981 | Tavel . | |
| 4,254,681 | 3/1981 | Kugisawa et al. | 84/1.01 |
| 4,269,101 | 5/1981 | Deutsch et al. | 84/1.01 |
| 4,271,743 | 6/1981 | Uchiyama . | |
| 4,276,802 | 7/1981 | Mieda . | |
| 4,281,218 | 7/1981 | Chuang et al. . | |
| 4,290,333 | 9/1981 | Sakashita . | |
| 4,296,665 | 10/1981 | Howell . | |
| 4,336,736 | 6/1982 | Mishima | 84/1.26 |
| 4,348,931 | 9/1982 | Wade . | |
| 4,374,482 | 2/1983 | Moore et al. | 84/1.24 X |
| 4,387,622 | 6/1983 | Deutsch | 84/1.22 |

OTHER PUBLICATIONS

"Modern Recording" magazine, published by Cowan Publishing Corp., vol. 4, No. 6, Mar. 1979, p. 15.

"Modern Recording" magazine, published by Cowan Publishing Corp., vol. 5, No. 6, Mar. 1980, pp. 32, 35.

"Keyboard" magazine, published by GPI Publications, vol. 9, No. 3, Mar. 1983, pp. 66, 68.

*Primary Examiner*—Stanley J. Witkowski

*Attorney, Agent, or Firm*—Stonebraker, Shepard & Stephens

[57] ABSTRACT

An electronic signal X can have its envelope shaped by an electronic control signal Y. For music purposes, signal X can be an electronically generated note and control signal Y can be derived from the musician's voice. The signal shape controller exponentially modifies the control signal Y and multiplies signal X by the exponentially modified control signal Y to form an output signal having an envelope shape $XY^n$. The exponent n has at least one value less than 1 applied to larger values of control signal Y and at least one value greater than 1 applied to lower levels of control signal Y. The controller also preferably includes an attack enhancement circuit to emphasize an attack portion of a control signal and a variable time integrator circuit that integrates the control signal over a short time interval when it is changing rapidly and over a longer time interval when it is changing slowly.

27 Claims, 9 Drawing Figures

SIGNAL SHAPE CONTROLLER

BACKGROUND

Electronic music is known for its mechanical sound. Although snythesizers can produce a wide variety of musical notes, the variations cannot be changed rapidly. Changes require turning knobs, moving levers, working pedals, or altering a computer program; and not many of these operations can be done during a performance. The inability to change envelope shapes quickly or spontaneously results in the same envelope shapes being repeated for many notes and gives the music a mechanical or machine-made sound lacking in sensitivity and expressiveness.

In contrast, skilled musicians with traditional instruments can vary their musical notes nearly instantly. Their variations occur as quickly as their fingers, lips, tongues, etc. can react to what they hear, and they can alter note shapes as rapidly as they occur. The result is fluently expressive music that communicates much more fully than has been possible for electronic music.

In working to bring electronic music under the expressive control of the performer, I have developed a signal shape controller that lets the musician shape the envelope of each note, as quickly as the notes are played. Controlling the envelope shapes controls the musical phrasing of the notes and lets the musician create electronic music as fluently expressive as music performed on traditional instruments.

My controller allows the musician's voice to control envelope shapes for fast and effective phrasing of electronic music. For any instrument that does not involve the musician's voice or mouth, the full range of expressiveness of speech and song is available for the musician to use in shaping notes otherwise produced electronically. It thus offers musicians a new source of expressive control that does not require mastery of the neuro-muscular techniques demanded to achieve expressive control with traditional instruments.

My controller also allows one instrument to control the envelope shapes of notes produced by another instrument so that the controlling sound is not limited to a musician's voice. My controller thus creates many new possibilities for interaction among musicians and makes new musical effects available to performers and composers.

By attenuating sounds weaker than the voice control signal used by the musician to phrase the music, my controller provides a noise reduction system that lets a microphone reject ambient sound. By making an audible output depend on the presence of an input control signal, my controller also eliminates hums and noise otherwise produced by electronic components in a music system. Moreover, the way my controller combines a controlled signal and a controlling signal makes possible new performance techniques that can vary the musical results.

SUMMARY OF THE INVENTION

My signal envelope shaper applies to a system that produces an electronic signal X to be shaped and an electronic control signal Y for controlling the shape of signal X. For music control, signal X can be an electronically generated note, and control signal Y can be derived from the musician's voice. My system exponentially modifies the control signal Y and multiplies signal X by the exponentially modified control signal Y to form an output signal having the envelope shape $XY^n$. The exponent n has at least one value less than 1 and at least one value greater than 1, and values of exponent n are selected in response to a state of control signal Y so that the exponent n has different values in different regions of the envelope of the output signal $XY^n$.

My system preferably includes a level detector and a variable time interval integrator that integrates control signal Y over a shorter time interval during a large rate of change in control signal Y and over a longer time interval during a smaller rate of change in control signal Y. My controller also preferably has the capability of varying the exponent n as a function of the rate of change of an attack portion of control signal Y to enhance the attack portion of the output signal $XY^n$.

DRAWINGS

FIG. 1 is a simplified schematic block diagram of a preferred embodiment of my signal envelope shaper;

FIG. 2 graphically represents the effects of three different values of exponent n for the controller of FIG. 1;

FIG. 3 graphically represents the preferred effects of a larger number of values of n for the controller of FIG. 1;

DETAILED DESCRIPTION

As applied to musical note phrasing, for which my signal shape controller was developed, I have found that the human voice offers the most fluent and expressive control source. Humans develop and expand voice ability from birth, and the human voice is quick, variable, and effective at communicating. Much electronic music is keyboard originated, leaving the musician's voice available for expressive control. Voice sound as a control also has the advantage of being closely analogous to the music sound to be controlled. Human hearing is highly responsive to sound expression within the tone, pitch, and speed ranges of human voices. Experimental comparisons with other means of human control also verify that the voice offers a rich and fluent source of control over the phrasing of musical notes.

I have found effective ways of using human voice sounds for shaping signal envelopes. I discovered that merely rectifying and detecting a control signal derived from a voice sound and using that as a multiplier to shape the envelope of a sound signal is unsatisfactory for several reasons. Such a control is far too slow for musical effectiveness. It requires the controlling voice sounds to range from whispers to shouts. The microphone or transducer picking up the voice sounds also picks up ambient noise, including the sound of the music being played, producing an unworkable interference. AC ripple in the voice control signal feeds through to distort the music signal output.

My experiments show that a controller for effective musical envelope shaping has to be fast. A full excursion of control must be achievable in less than 1 millisecond. For fluency, the control must also be delicate and sensitive so that small nuances of difference in the control signal can produce corresponding subtle effects in the output. The control must also be especially sensitive and fluent within the range of the human voice to take advantage both of the musician's voice varying ability and the listener's capacity for hearing.

Figure 1:
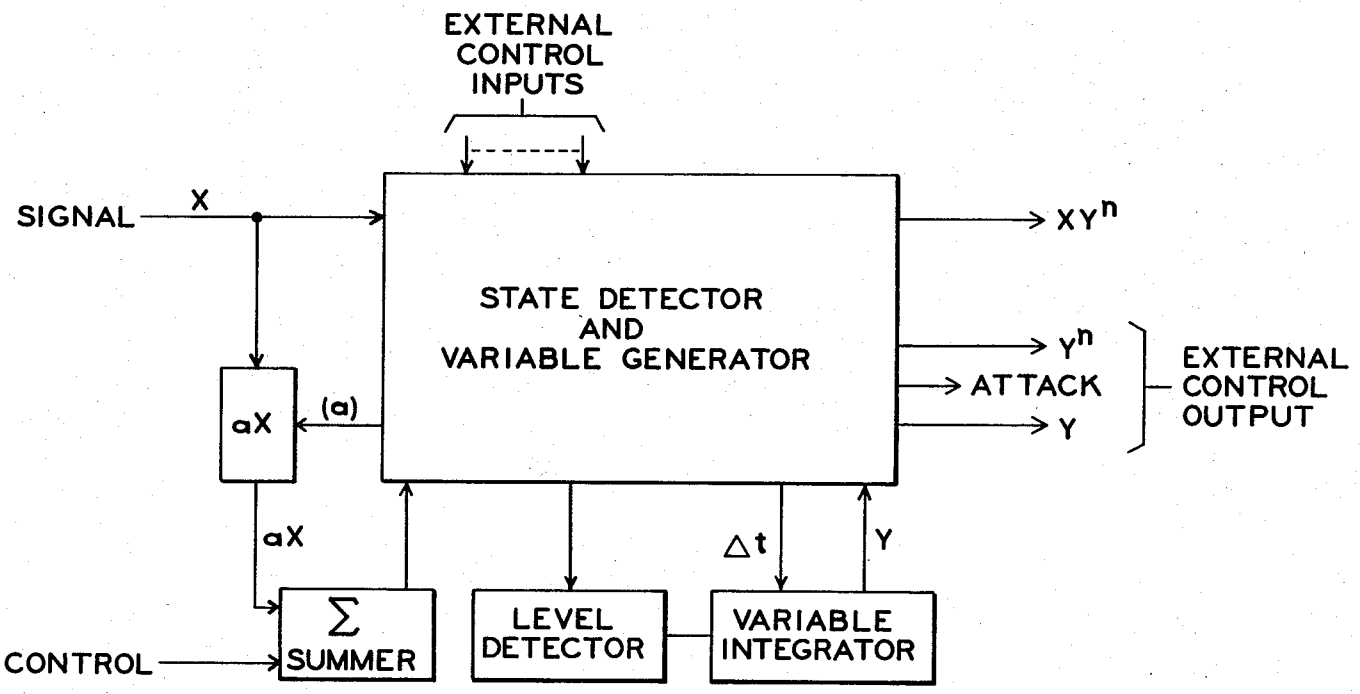

The simplified block diagram of FIG. 1 shows a preferred and workable arrangement. A signal X to be shaped can be an electronically produced signal for a musical note, and a controlling signal Y for shaping the envelope of the note can be derived from voice input. The control signal Y is detected, exponentially modified, and multiplied with the controlled signal X to produce an output in the form $XY^n$.

With such an arrangement, n should have at least one value less than 1 and at least one value greater than 1. Also, values of n larger than 1 should be used for lower levels of control signal Y to expand its lower range, and values of n less than 1 should be used for larger levels of control signal Y to compress its upper range. This arrangement helps the control respond quickly and move rapidly to the level where the human voice is most subtle and effective.

Figure 2:
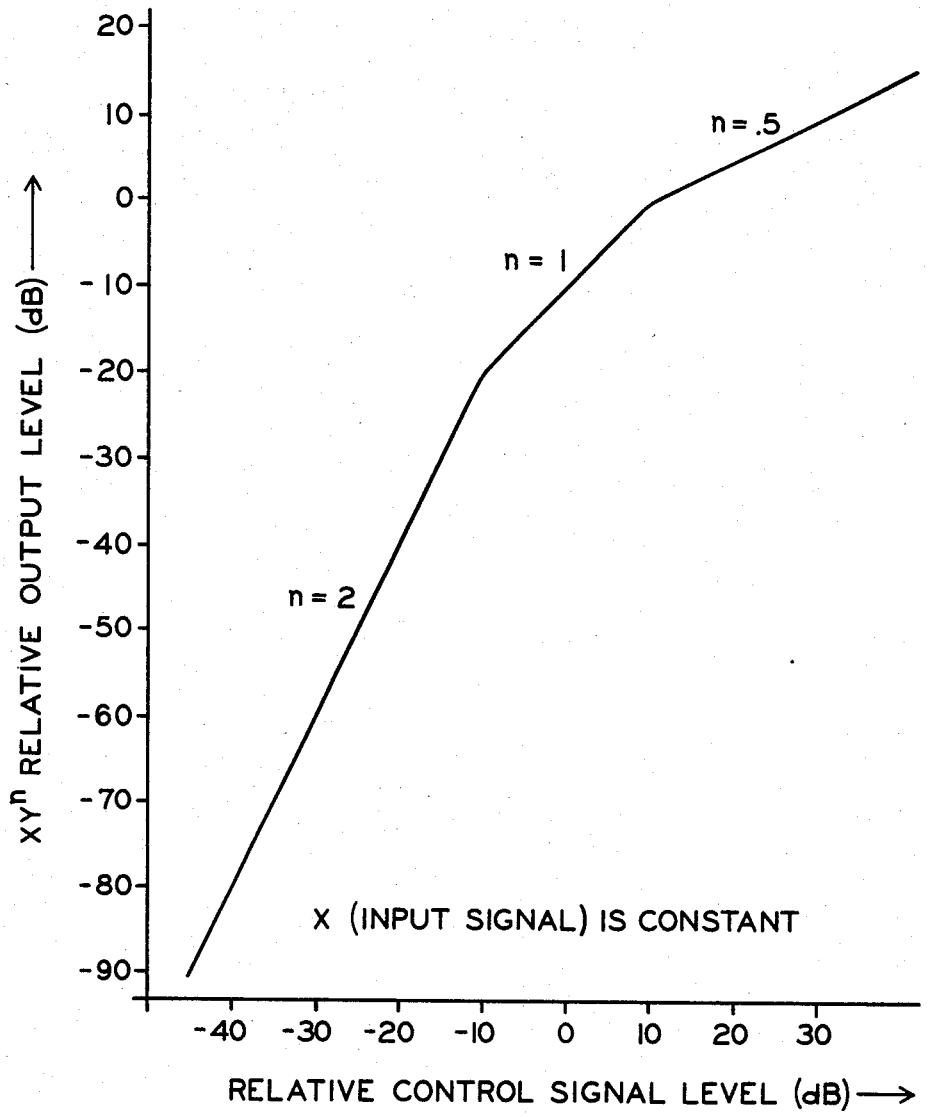
Figure 3:
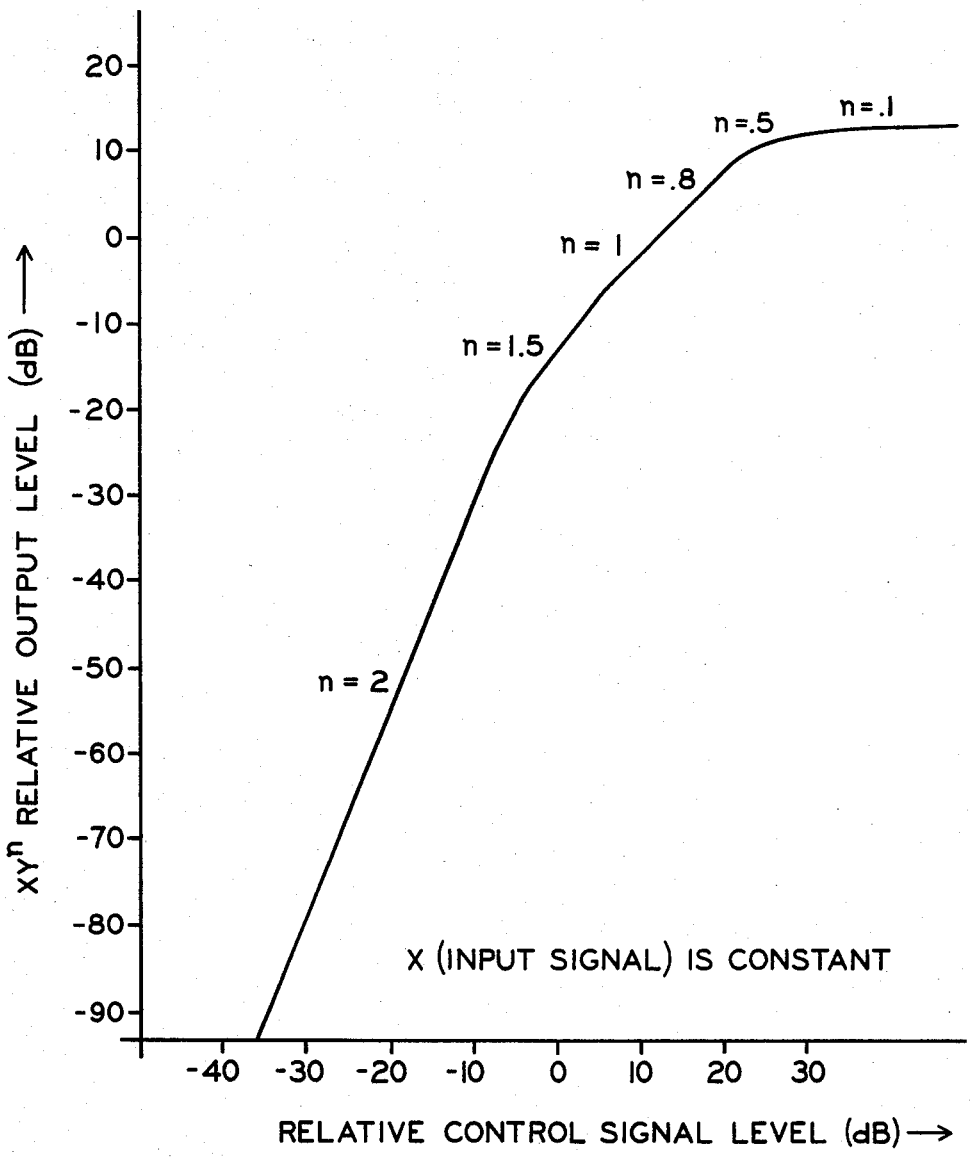

FIGS. 2 and 3 graphically show the preferred effect on the output signal $XY^n$ of varying the values of exponent n of control signal Y. Lower levels of control signal Y in the whisper ranges and below are expanded with an exponent n larger than 1. I prefer $n=2$ as shown in FIGS. 2 and 3 for low levels of control signal Y where the human voice is not as fluent and subtle as it is at higher levels. This also quickens the responsiveness by rapidly increasing the output signal as control signal Y rises toward normally audible voice values. Moreover, it expands ambient sounds, which rarely reach voice levels, and thus greatly attenuates their effect on the output.

Somewhat above the level that the vocal cords begin to vibrate and produce an audible voice sound comes the normal range of the human voice from quiet to loud, where a musician's voice can most subtly and sensitively control the phrasing of musical notes. To continue with an exponent n value greater than 1 in this range would make the system very difficult to control. Small variations in loudness of the voice control would cause exaggerated differences in output loudness.

So in this normal voice range, I reduce exponent n to lower values, compressing the control effect of signal Y. Values of n in the upper levels of the controlling voice range are preferably as low as $n=0.5$. In an intermediate voice level range, a value of $n=1$ as shown in FIG. 2 can form a workable linear control. Exponent n can also have a multitude of values including several values more than 1 and several values less than 1 for a more rounded output curve as shown in FIG. 3. Upper level values of n less than 0.5 make the controlling voice work harder for louder output notes, but this corresponds with the increasing effort required to sound exceptionally loud notes from traditional instruments.

Exponentially modifying control signal Y by using different values of n as explained matches my controller effectively to the capabilities of the musician's voice and enables versatile and sensitive musical phrasing. The control is fast and responsive because it quickly rises into the normal voice range. Thereafter it becomes less sensitive to changes in the level of the control signal so that the output sound is easily shaped with an effort that is comfortable for the performer. Other improvements advance the control capability of my device even further.

Another improvement for musical purposes is an integrator that is capable of integrating control signal Y over varying time intervals, depending on the rate of change of control signal Y. The level detection process inevitably produces an AC ripple composed of control signal products. There is always a trade-off between a fast detection rate and adequate filtering of the AC ripple by the integrator. I have found that AC ripple feeding through to the output signal cannot be heard if control signal Y is rapidly increasing or decreasing. Ripple feedthrough is quite noticeable when control signal Y holds a steady state, however.

My controller as shown in FIG. 1 preferably includes a variable integrator operated to integrate over different time intervals determined by the state detector and variable generator circuit. I have found that a suitable short time interval for integrating an attack or other rapidly varying portion of control signal Y should be around 1 millisecond and can range from 100 microseconds to 3 milliseconds. The ripple feedthrough that such a short integration permits is not audible in the output because of the rapid change that is occurring in the level of control signal Y.

I have also found that most of the audibly objectionable ripple feedthrough occurs at frequencies above 80 Hz because the ripple is composed of products of the control signal. To eliminate this, I prefer integration intervals ranging from 5 milliseconds to 120 milliseconds for relatively steady levels of control signal Y.

The preferred variable integrator can also be used for a sustain effect in response to an external input such as a foot pedal operated by the performer. A sustain control can increase the time interval of the variable integrator to range from 20 milliseconds to 2 seconds for sustaining the release time of musical notes. A provision for holding the control level constant can be optionally included to achieve infinite sustain duration.

Control signal Y can be derived wholly or partially from controlled signal X. A factor (a) having an externally assigned value ranging from 0 to 1 can determine the proportion of signal X used in forming control signal Y. Signal aX can be mixed or added with a control signal derived from an external source. The combined AC signals can be detected, variably integrated, and exponentially modified to shape the output to $XY^n$.

The aX signal derived from the controlled signal X can also be the sole source of a control signal Y. When signal X is derived from a sound input via a transducer such as a microphone, my controller makes the microphone reject noise. Ambient noise impinging on the microphone is expanded by the larger values of n applied to the lower levels of sound input. This expansion greatly attenuates ambient noise, which the microphone rejects in favor of the higher levels of signals intended for input. The control signal level can be adjusted so that larger values of input signals in the compression range where n is less than 1 are below the feedback level of amplified microphone/speaker systems. Such an arrangement effectively turns the microphone off to eliminate noise output whenever the microphone is not receiving a close-up, deliberate input. It also eliminates feedback squeal.

The state detector and variable generator as shown in FIG. 1 can be formed as a digital computer programmed to accomplish the exponential modification of control signal Y and associated functions as described above. Conversion of signals from analog to digital allows a wide range of digital processing techniques to be used in accomplishing the desired result.

With either a digital or analog arrangement, the state detector can provide several useful outputs such as Y, $Y^n$, $Y^{n/2}$, and an attack pulse. These can be input to a music synthesizer as control signals usable to create synthesized music effects.

I prefer several external inputs to the state detector and variable generator. These include the usual amplifier gain controls and system bypass and also preferably include an input to establish the value of factor (a) ranging from 0 to 1, a sustain input as explained above, and an adjustment for an amount of attack enhancement as explained below. The bandwidths of the signal and control inputs are preferably set to accommodate the type of signals to be processed.

Figure 4:
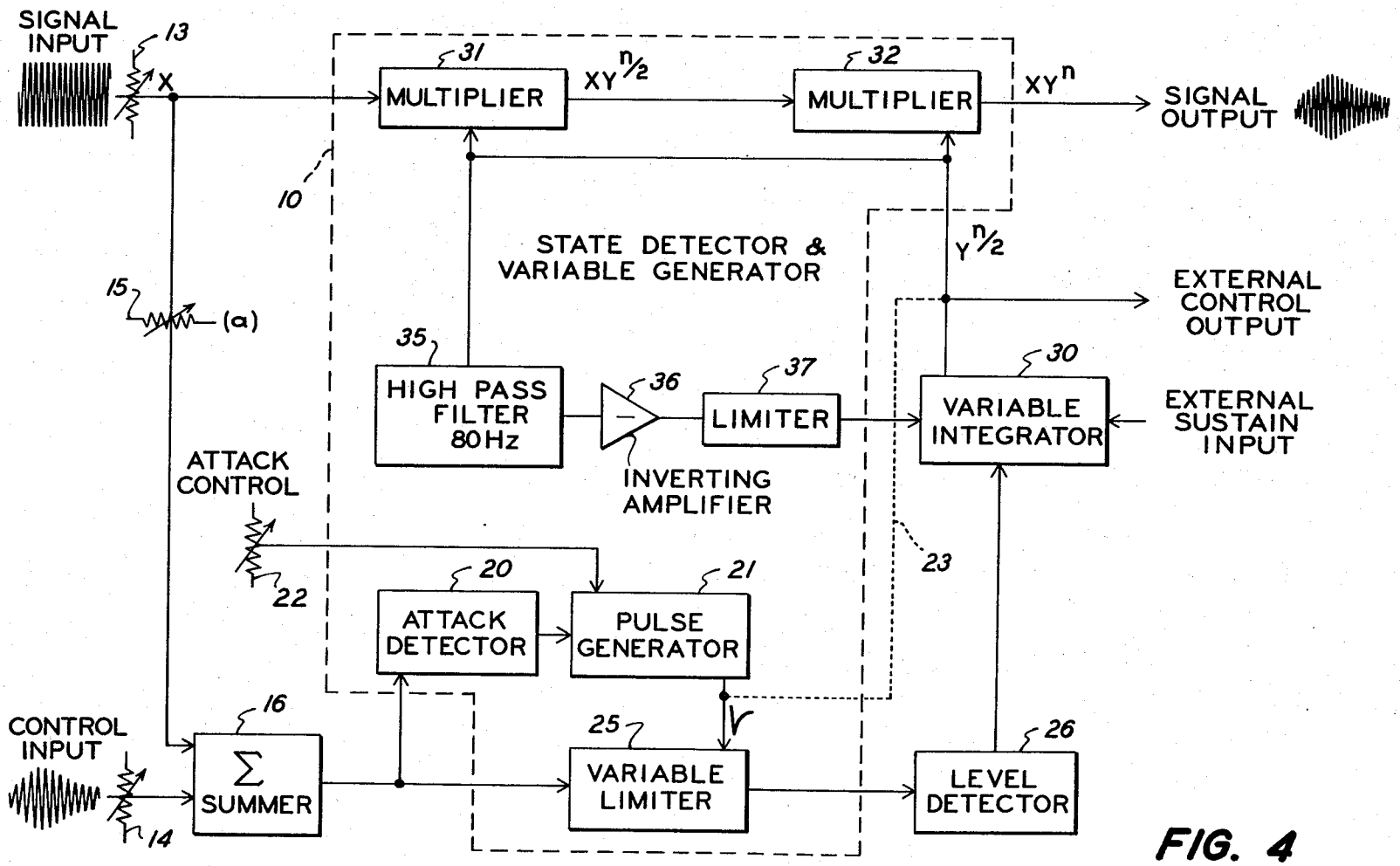
FIG. 4 is a more detailed schematic block diagram of a preferred embodiment of my controller.

Attack enhancement and preferred ways of accomplishing several other functions are shown in the circuit diagram of FIG. 4. Beginning with inputs at the left side of the diagram, an X signal input level can be adjusted by potentiometer 13 for output level variation; and a control input level can be adjusted by potentiometer 14. Another potentiometer 15 sets the value of factor (a) between 0 and 1 for any derivation of control input from the X signal. If the control signal is formed from more than one input, these are mixed or added together at summer 16. State detector and variable generator 10 includes the components contained within the broken-line box.

Attack detector 20 is arranged for identifying an attack portion of a control signal so that the attack can be enhanced. I have found that for music purposes, an attack portion of the control signal can be identified by a positive excursion lasting more than 100 microseconds following absence of a control signal for at least 20 milliseconds. The aim is to identify an attack portion of the control signal as rapidly as possible without mistaking noise transients as control attacks. Also, the requisite period of elapsed silence ensures that only one attack can be detected after a control signal begins.

Upon identifying a control signal attack, detector 20 triggers pulse generator 21 to produce a pulse that can vary in width and amplitude, preferably by adjustment of an attack control potentiometer 22. I have found that for musical purposes, a pulse width range of from zero to 50 milliseconds is adequate, and the pulse level is preferably variable. The generated pulse is preferably used to enhance the attack portion of the control signal and thus enhance the attack portion of the output envelope. This can be done in at least two ways. One way, schematically suggested by broken line 23, is to add the pulse to the detected and variably integrated control signal to sharpen and increase its attack portion according to the attack control setting. However, I prefer applying the pulse to variable limiter 25 where it accomplishes attack enhancement in a simple and effective way, allowing the musician to control the degree of enhancement by choosing appropriate voice sounds.

Variable limiter 25 normally limits higher levels of the control signal so as, to compress its upper range exponentially. An attack enhancement pulse applied to variable limiter 25 reduces this limiting function according to the magnitude and duration of the pulse and allows a large control signal to pass unattenuated, as do lower control levels. An unlimited control signal makes n=2 in the output signal (as explained below) so that during the attack portion of the control signal, the large value of n squares the control signal and increases its level to enhance the attack.

Following attack enhancement, if any, level detector 26 converts the control signal to a DC voltage, and variable integrator 30 integrates the DC signal over varying time intervals. The output from variable integrator 30 is a control signal defined as $Y^{n/2}$. The value of n/2 is determined by variable limiter 25, depending on the level of the incoming control signal and the application of any attack enhancement. For low levels of control input and for attack enhancement intervals, the incoming control signal passes through limiter 25 without attenuation, giving n a value of 2, so that $Y^{n/2}$ equals $Y^{2/2}$ equals Y. Multiplying Y with signal X twice at multipliers 31 and 32 forms an output signal $XY^2$, with n at its preferred maximum value of 2. This signal expansion is shown in the lower portions of the curves of FIGS. 2 and 3.

At higher levels of control input, variable limiter 25 exponentially reduces the value of Y so that n has a smaller value. For example, limiter 25 can reduce the value of n to 0.5 at higher levels of control input so that $Y^{n/2}=Y^{.25}$. Multiplying this exponentially limited Y signal twice with the X signal at multipliers 31 and 32 produces an output of $XY^{.5}$ for a compressed signal as shown in the upper portion of the curve of FIG. 2. Variable limiter 25 can also set intermediate and lower values of n as shown in the curves of FIGS. 2 and 3.

Variable integrator 30 uses a shorter time interval during rapid changes of the control signal and a longer time interval during slower changing portions of the control signal as previously explained. A bank of capacitors and an electronic switching system is one possible way of accomplishing this, but I prefer a negative feedback system involving state detector and variable generator 10 as illustrated.

The variable integration feedback loop includes a high pass 80 Hz filter 35, an inverting amplifier 36, and a limiter 37. Variable integrator 30 has a minimum integration interval of preferably less than 1 millisecond for short time integration during rapid changes of the control signal. Amplifier 36 saturates DC limiter 37 during rapid changes in control signal level; and this reduces the negative feedback of signals above 80 Hz to integrator 30, which integrates the control signal for a minimum time interval. As change in the control signal diminishes, limiter 37 unsaturates and passes this negative feedback to integrator 30. The negative feedback is arranged to multiply the effect of the integrating capacitor in integrator 30, resulting in longer intervals of 5–120 milliseconds appropriate for filtering ripple out of the control signal.

Filter 35 passes the AC voice and musical instrument frequencies that cause audible ripple in the output, so that these are integrated and averaged out by the longer time interval. Lower frequencies composed of vibrato, tremolo, and the envelope itself do not pass through filter 35 and are thus eliminated from the feedback loop to remain a part of the control signal, as intended by the performer creating such effects.

An external sustain input, applied via a sustain pedal, for example, increases the integration time of integrator 30 to a range from 20 milliseconds to 2 seconds or longer. This manually increases the release time of notes.

An output of the control signal in the form of Y, $Y^n$, or $Y^{n/2}$ can provide a useful source to a music synthesizer for varying musical effects. The attack enhancement pulse can also be used as an input to a synthesizer.

A saturating amplifier can exponentially reduce higher levels of the control signal and substitute for variable limiter 25, or limiter 37. Also, although I prefer limiting the control signal in its AC form, this can be done after the control signal is convertd to DC by level detector 26. It is also possible to limit the X input or output signal instead of the control signal, but that is not as satisfactory because of the distortion the limiter causes.

Figure 5:
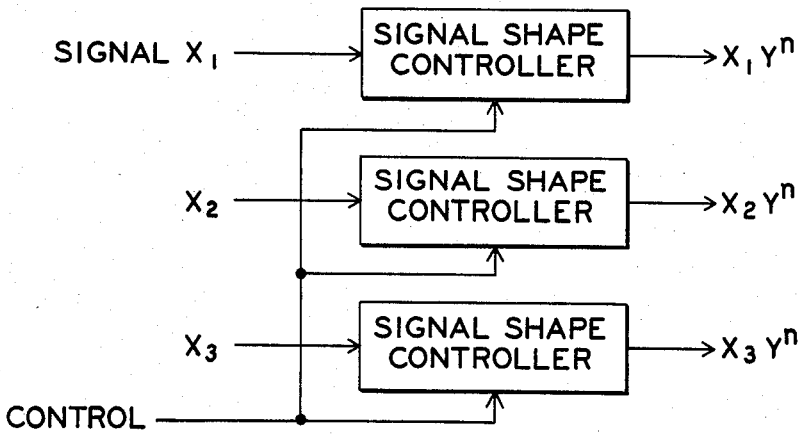
FIGS. 5–7 are schematic diagrams showing multiple input and output configurations of my signal shape controller.
Figure 6:
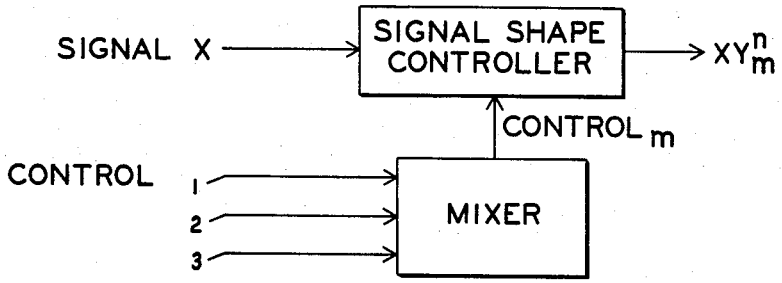
Figure 7:
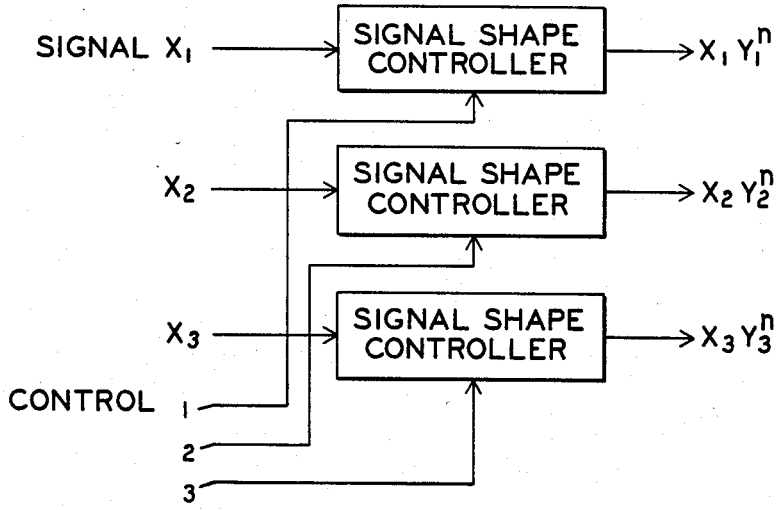

My controller can be used in a wide variety of ways as schematically suggested in FIGS. 5–7. In FIG. 5, for example, a single control input Y can shape the envelopes of several X signals. In a music environment, this could be done by one voice or instrument providing the control over the envelope shapes of several other instruments. The overall integration time, sustain, or attack of each can be separately adjusted for a multiplicity of interactive envelope shapes. A drum or a rhythm instrument providing the control is one effective possibility, and many different multiple musical control arrangements may prove worthwhile.

As shown in FIG. 6, several control inputs can be combined to form a composite control signal $Y_m$ used to shape a single X signal. This is analogous to combining an external control input with a control derived from the X signal input as already explained. It could also involve several external control inputs from several voices or instruments.

The arrangement of FIG. 7 shows several control signal inputs respectively controlling several X signals. The control inputs and signals being controlled can be relatively independent but cooperating for musical effects. Also, a single performer can face an array of control input microphones that are used selectively to shape the envelopes from several instruments or sounds.

My signal shape controller is not limited to musical purposes. It can be used to shape the envelopes of video and other signals.

Figure 8:
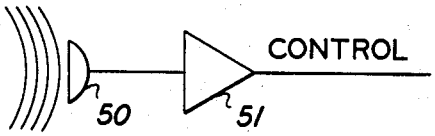
FIG. 8 is a schematic diagram showing a microphone and amplifier arrangement for control input to my signal shape controller.

For microphone input of control signals, I have found that simple, small, and inexpensive microphones such as used for telephone circuits are adequate, although directional microphones enhance performance. Such a microphone 50 receiving an audio signal amplified by amplifier 51 to form an AC input is shown in FIG. 8. My controller can also work in cooperation with breath-responsive devices incorporated into synthesizers for controlling pitch or loudness. The breath transducer can be used in place of microphone 50.

Figure 9:
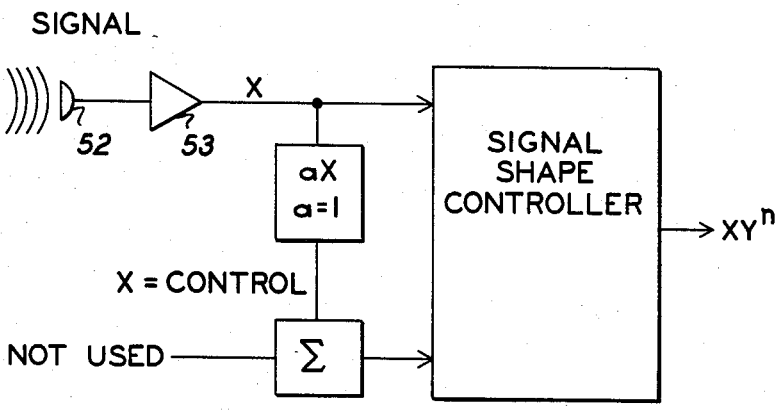
FIG. 9 is a schematic diagram showing use of my signal shape controller for a noise-rejecting microphone.

Another microphone 52 can receive an audio input amplified by amplifier 53 to form an X signal as shown in FIG. 9. By increasing the value of (a), control signal Y can be derived from such an X signal; and by using the derived signal Y as a control input to my signal shape controller, microphone 52 can be made noise rejecting as explained above. An output signal $XY^n$ can be made to occur only when the input to microphone 52 produces an adequate level of control signal Y. Any attack enhancement is preferably adjusted to compensate for the small time delay caused by the integrator so as to preserve the envelope shape of the incoming signal. The time interval of variable integrator 30 for the steady state conditions is also preferably lengthened to provide smooth operation when processing the spoken word.

My controller allows performance techniques not previously available. For example, a rapid series of notes all having the same pitch can be formed by the performer's voice while holding a single key depressed. Sounding "da-ta-ta-ta" while holding one key can produce four rapid notes; and since the voice is quicker than the fingers, a performer can produce voiced notes faster than the neuromuscular ability of his fingers.

It is also possible to prerecord the notes of a piece of music and use voice control to shape the envelopes of the notes as they are played back. This can relieve a performer of the task of operating keys to form the notes and can allow concentration on voice expression to phrase notes that are separately created. Performers lacking the skill to produce fluent music with traditional instruments can exercise their expressive ability over notes produced in some other way.

Using the sound from one instrument to phrase the notes from another creates vast musical potential. For example, a drum's ability to produce quick, sharp beats creates musically unique effects when controlling the envelope shapes of notes played by other instruments.

My signal shape controller also offers possibilities for voice control of games or musical toys. A music box, for example, could be made to produce many versions of a tune in response to singing or other sound effects. As a teaching tool, a rhythmic accompaniment could establish a control signal helping a music student learn rhythm.

I claim:

1. A signal envelope shaper comprising:

a. means for producing an electronic signal X to be shaped;

b. means for producing an electronic control signal Y for controlling the shape of signal X;

c. means for exponentially modifying said control signal Y and for multiplying said signal X by said exponentially modified control signal Y to form an output signal having the envelope shape $XY^n$;

d. means for providing exponent n with at least one value less than 1 and at least one value greater than 1; and e. means for selecting a value of said exponent n in response to a state of said control signal Y so that said exponent n has different values in different regions of the envelope of said output signal $XY^n$.

2. The signal shaper of claim 1 including a variable time interval integrator arranged for integrating said control signal Y over a shorter time interval during a large rate of change in control signal Y and over a longer time interval during a smaller rate of change in control signal Y.

3. The signal shaper of claim 1 including a transducer arranged for producing said control signal Y from an input.

4. The signal shaper of claim 3 including a level detector and a variable time interval integrator arranged for integrating said control signal Y over a shorter time interval during a large rate of change in control signal Y and over a longer time interval during a smaller rate of change in control signal Y.

5. The signal shaper of claim 1 wherein said selecting means includes a state detector responsive to the level of said control signal Y for selecting an exponent n value larger than 1 for lower levels of control signal Y and for selecting an exponent n value less than 1 for higher levels of control signal Y.

6. The signal shaper of claim 5 including a level detector and a variable time interval integrator arranged for integrating said control signal Y over a shorter time interval during a large rate of change in control signal Y and over a longer time interval during a smaller rate of change in control signal Y.

7. The signal shaper of claim 6 including a transducer and an amplifier arranged for producing said control signal Y from an input signal.

8. The signal shaper of claim 6 including means for providing said state detector with an external input arranged for varying the time range for said integrator to change the response of said output signal to said control signal.

9. The signal shaper of claim 8 wherein said external input includes a sustain pedal arranged for lengthening the said time range for said integrator.

10. The signal shaper of claim 6 including means for selectively combining a plurality of signals to produce said control signal Y.

11. The signal shaper of claim 6 including means for producing a plurality of said electronic X signals each being shaped by said control signal Y.

12. The signal shaper of claim 6 including an external output and means for providing said exponentially modified control signal Y to said external output.

13. The signal shaper of claim 6 including means for producing an attack enhancement pulse, and means for adding said attack enhancement pulse to said exponentially modified control signal Y during an attack portion of said control signal Y.

14. The signal shaper of claim 6 including means for producing an attack enhancement pulse, and means for providing said attack enhancement pulse to an external output.

15. The signal shaper of claim 1 wherein said selecting means includes a state detector arranged for variably selecting larger values of said exponent n in response to rate of change of an attack portion of said control signal Y, and wherein said state detector is otherwise responsive to the level of said control signal Y for selecting an exponent n value larger than 1 for lower levels of control signal Y and for selecting an exponent n value less than 1 for higher levels of control signal Y.

16. The signal shaper of claim 15 wherein said state detector includes a level detector and a variable time interval integrator arranged for integrating said control signal Y over a shorter time interval during rapid change in control signal Y and over a longer time interval during slower change in control signal Y.

17. The signal shaper of claim 16 including a transducer and an amplifier arranged for deriving said control signal Y from an input signal.

18. The signal shaper of claim 16 including means for providing said state detector with an external input arranged for varying the time range for said integrator to change the response of said output signal to said control signal.

19. The signal shaper of claim 16 including an external output and means for providing said exponentially modified control signal Y to said external output.

20. The signal shaper of claim 16 including means for selectively combining a plurality of signals to produce said control signal Y.

21. The signal shaper of claim 16 including means for producing a plurality of said electronic X signals each being shaped by said control signal Y.

22. The signal shaper of claim 1 wherein said means for producing said control signal Y includes means for deriving said control signal Y from said signal X.

23. The signal shaper of claim 22 including means for multiplying controlled signal X by a factor (a) to form said control signal Y, said factor (a) ranging in value from more than 0 to 1.

24. The signal shaper of claim 23 wherein said selecting means includes a state detector responsive to the level of said control signal Y for selecting an exponent n value larger than 1 for lower levels of control signal Y and for selecting an exponent n value less than 1 for higher levels of control signal Y.

25. The signal shaper of claim 24 including a variable time interval integrator arranged for integrating said control signal Y over a shorter time interval during a large rate of change in control signal Y and over a longer time interval during a smaller rate of change in control signal Y.

26. The signal shaper of claim 24 wherein a transducer receiving an acoustic signal produces said controlled signal X so that said $XY^n$ output signal rejects acoustic noise ambient to said transducer.

27. The signal shaper of claim 26 including a variable time interval integrator arranged for integrating said control signal Y over a shorter time interval during a large rate of change in control signal Y and over a longer time interval during a smaller rate of change in control signal Y.

* * * * *